US008088193B2

(12) United States Patent
Zeng et al.

(10) Patent No.: US 8,088,193 B2
(45) Date of Patent: Jan. 3, 2012

(54) METHOD FOR MAKING NANOPARTICLES

(75) Inventors: Taofang Zeng, Raleigh, NC (US); Chunwei Wu, Raleigh, NC (US)

(73) Assignee: Taofang Zeng, Raleigh, NC (US)

( * ) Notice: Subject to any disclaimer, the term of this patent is extended or adjusted under 35 U.S.C. 154(b) by 174 days.

(21) Appl. No.: 11/958,326

(22) Filed: Dec. 17, 2007

(65) Prior Publication Data

US 2008/0264205 A1 Oct. 30, 2008

Related U.S. Application Data

(60) Provisional application No. 60/875,255, filed on Dec. 16, 2006.

(51) Int. Cl.
*B22F 9/24* (2006.01)

(52) U.S. Cl. ..... 75/345; 75/352; 75/354; 205/74; 205/340; 977/899

(58) Field of Classification Search ..... 75/371, 75/372

See application file for complete search history.

(56) References Cited

U.S. PATENT DOCUMENTS

| | | | | |
|---|---|---|---|---|
| 6,919,009 | B2 * | 7/2005 | Stonas et al. | 205/74 |
| 7,591,872 | B1 * | 9/2009 | Jun et al. | 75/371 |
| 2007/0034052 | A1 * | 2/2007 | Vanheusden et al. | 75/362 |

OTHER PUBLICATIONS

Chunwei Wu Abstract from Springerlink, published Mar. 2006.*
Wu, C. et al., "Simple One-Step Synthesis of Uniform Disperse Copper Nanoparticles", Materials Research Society Symposium Proceedings, vol. 879E, pp. Z6.3.1-Z6.3.6, 2005.*
Wu et al., "Rapid Synthesis of Gold and Platinum Nanoparticles Using Metal Displacement Reduction with Sonomechanical Assistance", Chemistry of Materials vol. 18, No. 13, pp. 2925-2928 (2006).
Wu et al., "One-step green route to narrowly dispersed copper nanocrystals", J. of Nanoparticle Research 8, pp. 965-969 (2006).
Wu et al., "Size-Tunable Synthesis of Metallic Nanoparticles in a Continuous and Steady-Flow Reactor", Chemistry of Materials vol. 19, No. 2, pp. 123-125 (2007).
International Search Report for International Application No. PCT/US2009/031008.
International Preliminary Report on Patentability for International Application No. PCT/US2009/031008.
Zhang, G. et ai, Thin Solid Films 1998, 332, 379-384.
Zhu, J. et ai, Langmuir 2000, 16, 6396-6399.
Jiang, L.-P. et ai, Inorganic Chemistry 2004,43,5877-5883.

* cited by examiner

*Primary Examiner* — George Wyszomierski
(74) *Attorney, Agent, or Firm* — Squire, Sanders & Dempsey (US) LLP

(57) ABSTRACT

A method for making nanoparticles includes the steps of dipping a metal element in a solution that contains metallic ions or ions with a metal, wherein the metal element has a lower electronegativity or redox potential than that of the metal in the ions, and rubbing the metal element to make nanoparticles. Another method for making nanoparticles includes the steps of dipping a metal element in a solution that contains metallic ions or ions with a metal, wherein the metal element has a lower electronegativity or redox potential than that of the metal in the ions, and applying sonic energy to at least one of the metal element and solution. A further method for making copper nanoparticles includes the step of adding ascorbic acid to a copper salt solution.

19 Claims, 13 Drawing Sheets

METHOD FOR MAKING NANOPARTICLES

This application claims the benefit of U.S. Provisional Patent Application No. 60/875,255, filed Dec. 16, 2006, the entire disclosure of which is incorporated herein by reference.

TECHNICAL FIELD OF THE INVENTION

The present invention relates to a method for making nanoparticles.

BACKGROUND OF THE INVENTION

A multitude of nanoparticles including metal and oxide, semiconductor, core-shell composite architectures, and organic polymers nanoparticles have been developed to date, which exhibit novel properties and potential applications as nanotechnological building blocks. Fundamental and applied research on synthetic methods and properties of these nanoscale objects has attracted sustaining passion during the past decade as scientists strive toward perfection. However, at present, a general synthetic strategy in a continuous manner and in a way that can produce particles with size and monodispersity tuning, economy or facility, and environmental friendliness is still not available.

It is well known that controlled size and structure of nanoparticles are critical to achieve tunable physical and chemical properties of nanoparticles. For instance, in "structure sensitive" catalytic reactions there is an ideal size and morphology for metallic nanoparticles on the catalyst surface for optimum reaction conditions. Much higher catalytic efficiency can be achieved if a monomodal distributions can be produced. Moreover, advanced application of nanoparticles as building blocks for bottom-up assembly and construction of a nanoscale device requires the ability to process and maneuver particles, which makes a more strict demand for size selection.

Currently the predictable control of particle size and size distribution remains an important challenge, although some strategies have been performed and proven successfully. These strategies include controlling the concentration of capping agents, employing reverse micelles as microreactor and using dendrimer, or nano- or meso-porous matrices as encapsulation templates. However, reverse micelles and the porous templates are hard to remove after syntheses and are not ideal for producing pure and uncontaminated nanoparticles. Decomposition of organometallic precursors is also typically effective to obtain uniformly dispersed nanoparticles; however, it is still not desired in terms of cost and environmental perspectives.

SUMMARY OF THE INVENTION

In light of the foregoing and other problems of the conventional methods and process, an objective of the present invention is to provide an inexpensive chemical method for preparing stable elemental, alloy, intermetallic and over-coated nanoparticles.

Based on the basic chemical principle that a metal ion with a relatively higher reduction potential can be reduced to a corresponding metal atom by another metal atom with relatively lower reduction potential, we, in the first instance, exploit metal displacement reduction reactions and bring forward a new species of reduction medium for nanoparticles synthesis—metal foils, such as aluminum, iron and magnesium foil. The inherent low reduction potential of these active metals ($E_{Al^{3+}/Al}$=−1.67 V; $E_{Fe^{2+}/Fe}$=−0.44 V; $E_{Mg^{2+}/Mg}$=−2.37 V) easily reduces metal ions with higher reduction potential, such as silver ($E_{Ag^{+}/Ag}$=0.80 V), copper ($E_{Cu^{2+}/Cu}$=0.34 V), cobalt ($E_{Co^{2+}/Co}$=−0.28 V) and iron in a solution phase. The reduced metallic atoms then grow into nanoparticles through a series of nucleation and aggregation kinetic processes. Unlike with traditional homogeneously dissolved reducing agents, metal ions in a solution reduce on the foil surface. Due to inter-molecular forces, the reduced atoms and resulting nuclei and particles have a tendency to accumulate on the foil surface, leading to plating and bulk formation. This phenomenon prevents the reduced metallic atoms from entering the solution phase and subsequently forming nanoparticles. Severe coverage of the foil surface by plating will stop the reduction reaction completely.

In the first aspect of the present invention, we developed a method to overcome deposition of reduced metals on the metal foil. The method is derived from chemical-mechanical planarization: We employ a rubbing member, such as a polishing pad or a "scrubbing" brush, in contact with a rotating metal foil, which immediately removes newborn atoms or atom clusters from the foil surface. Alternatively, the rubbing member may be moving while the metal foil remains stationary. In the method, turbulent agitation resulting from a high-speed rotation of a substrate disk and the attached foil in the solution further helps eject the atomistic species from the foil, transferring them into the bulk phase and creating a uniform suspension. The mechanical and hydrodynamic forces effectively prevent plating and bulk formation and distribute particles evenly in solution providing more homogeneous particle nucleation and growth.

For some pairs of metal foils and metal salts such as Fe foil and silver nitrate ($AgNO_3$) for Ag nanoparticles synthesis, the reaction rate is relatively slow compared to traditional chemical reduction process. The slow reduction rate implies a progressive release of metallic atoms into the solution and thus progressive nucleation, which leads to a broad nanoparticle size distribution.

To offset progressive nucleation and realize better size and distribution variation, the present invention employs a continuous flow reaction system rather than the typical batch system. A typical reaction system includes a rotating metal element such as a rotating plate with metal foil immersed in an ionic solution. The metal foil is scrubbed by a rubbing member such as a soft pad or brush. A same ionic solution is supplied continuously to the reactor, and the same amount of liquid loaded with particles flows out of the reactor. The continuous steady-state vessel, characterized by a feeding stream and an exit stream, allows regulated control of average residence time of the produced nanoparticles, providing particles of selected size and distribution. Furthermore, the ion (salt)—foil pair can be selected to achieve the pair potential difference which results in the desired particle size and dispersity, thus providing broader opportunities in size tuning.

Metal displacement reduction refers to the spontaneous electrochemical reaction in which a metal ion is reduced to the corresponding zerovalent atom state with the concurrent oxidation of a more electropositive metal placed in the same solution. The reaction usually terminates due to the deposition and blanketing of the reduced metal onto the surface of the oxidizing metal. An analogous displacement reduction has been employed to generate gold nanoboxes and nanocages with hollow structure by using silver nanocubes synthesized during a polyol process as sacrificial templates. Unlike conventional metal displacement, their reaction is somewhat homogeneous and plating of gold on the silver nanocubes is desirable.

Preferably, with the present invention, the nanoparticles are protected from oxidation by using an anti-oxidant such as vitamin C during formation of metal nanoparticles.

In the second aspect of the present invention, we employ sonic energy such as employing an ultrasonic or subsonic brushless brush to remove newborn atoms or atom clusters from the foil surface. We take advantage of sonic vibrations to successfully overcome plating hindrances and bulk formation. In the synthesis, when atoms are being generated by reduction, ultrasonic vibration effectively ejects them from foil surface into bulk solution and the dispersed atoms nucleate and grow into a uniform nanoscale colloidal suspension.

The ultrasound effect has been explored in sonoelectrochemical and sonochemical syntheses of various metallic nanoparticles including Au, Ag, Cu, Zn and Fe. The sonoelectrochemical reduction has been characterized by an electrolysis cell including a power supply, cathode (a titanium horn pulsed sonoelectrode), anode and electrolyte solution. Sonochemical reduction is usually realized by a direct immersion of a continuous high-intensity ultrasound titanium horn into the metal ion solution. The whole sonochemical process typically lasts for several hours. Usually alcohol molecules such as propanol are added for a higher yield of ultrasound-induced secondary reducing radicals. The particle size and particle formation efficiency is dependent on the presence, type and concentration of the alcohol. In these reactions, electrons from the external power supply and the ultrasound induced free radicals were attributed to be the reducing source in sonoelectrochemical and sonochemical reduction respectively, while ultrasound was speculated to be aiding in removing the electrodeposited particles on the sonocathode surface.

In fact, the electrochemical reduction itself can produce atoms. For example, the Au and Pt atoms can be generated by using the following metal displacement reactions, $$[AuCl_4]^-(aq)+Cu(s)\rightarrow Au^o(s)+Cu^{2+}(aq)+Cl^-(aq)$$
$$E_{Au^{3+}/Au}{}^o=1.50V$$

$$[PtCl_6]^{2-}(aq)+Fe(s)\rightarrow Pt^o(s)+Fe^{2+}(aq)+Cl^-(aq)\ E_{Pt^{4+}/Pt}{}^o=1.47V$$

$$E_{Cu^{2+}/Cu}{}^o=0.34V$$

$$E_{Fe^{2+}/Fe}{}^o=0.44V$$

What is needed is to dislodge the formed atoms from deposition on the surface of the metal (in the above two reactions, the metals are Cu and Fe). We apply the above displacement (electrochemical) reaction to generate Au and Pt atoms, and use ultrasound to dislodge atoms from the metal foils. Ultrasound is a good means to perform just such a function. Under ultrasonication the propagation of pressure waves in solution causes the formation of acoustic microstreaming and acoustic cavitation. The acoustic microstreaming can then dramatically enhance mass transfer at the foil-liquid interface by reducing the ionic concentration gradient. The extreme high temperature and pressure inside the cavitation bubbles initiate the formation of reducing free radicals, which are responsible for the sonoreduction. Collapsing or imploding of the bubbles creates physical effects such as shear forces and shock waves11 and the formation of liquid jets. All these effects help to impinge and pit against the foil surface through a scrubbing action to dislodge the particles so as to prevent bulk formation. Instead of a powerful Ti-horn that is generally used in sonoelectrochemical and sonochemical reduction, we employed a common laboratory ultrasonication cleaner to facilitate the continuous reduction of atom species from the bulk metal foils. The method is called sonomechanical-assisted-metal displacement reduction or UAMDR for short.

Preferably, with the present invention, the nanoparticles are protected from oxidation by using an anti-oxidant such as vitamin C during formation of metal nanoparticles.

In the third aspect of the present invention, the inventors have developed an inexpensive, green method for the preparation of copper nanocrystals using vitamin C.

BRIEF DESCRIPTION OF THE DRAWING

The foregoing and other purposes, aspects and advantages, as well as synthesis approaches and characterized results of the present invention, will be better understood from the following detailed description of preferred embodiments of the invention with reference to the drawings, in which.

DETAILED DESCRIPTION OF PREFERRED EMBODIMENTS OF THE INVENTION

Figure 1:
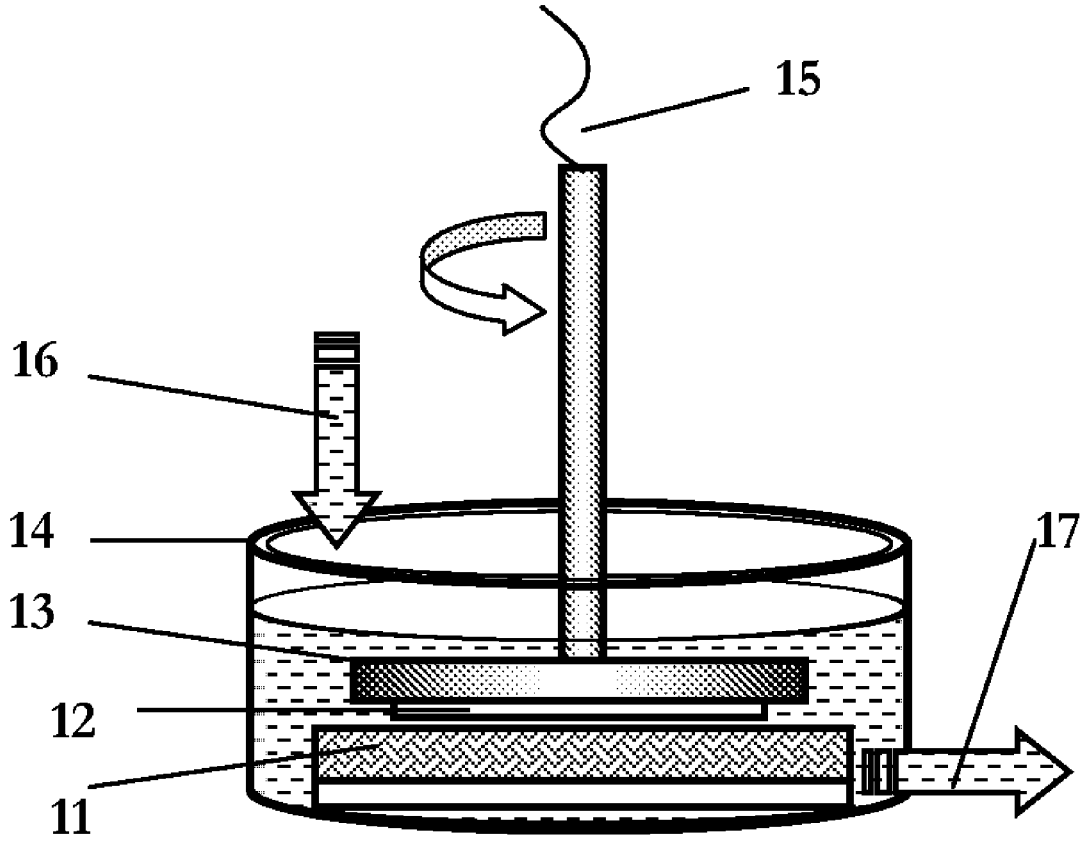
FIG. 1 shows the schematic setup of the chemical-mechanical polishing method for the synthesis of metallic nanoparticles.

Referring to the drawings and more particularly to FIGS. 1-13, embodiments of the invention are illustrated as followed.

The present invention may be an economic and scalable process for preparing monodisperse nanoparticles of most transition metals as well as their alloys and oxides in three different methods. As illustrated below, high-quality nanoparticles of Au, Ag, Cu, Pt, Fe, Co, Ru, Sn, $Cu_2O$ and $Fe_3O_4$ are synthesized by chemical-mechanical planarization, sono-mechanical-assisted-metal displacement reduction and direct chemical reduction through ascorbic acid.

The first part of the present invention is chemical-mechanical metallic nanoparticles synthesis strategy, or hydrodynamically and mechanically assisted metal displacement reduction in a continuous and steady-flow reaction system. The method is based on the heterogeneous reduction of metal precursor ion by a piece of active metal foil with the aid of deplating and mass transport resulting from mechanical and hydrodynamic forces. The invention allows simple and green synthesis and continuous production. Size selectivity and size distribution control can be acceptably realized in a straightforward manner by adjusting reactant concentration and particle average residence time in the continuous flow system.

The universal oxidoreduction principle states that a metal ion or ion complex can be reduced to corresponding atomic state in solution by another metal with relatively lower reduction potential, we, in the first instance, exploit bulk metal foil as heterogeneous reducing medium and therefrom metal displacement reduction as a new approach for nanoparticles generation. The relatively active metals with low reduction potentials ($E^o_{Al^{3+}/Al}$=−1.67 V; $E^o_{Fe^{2+}/Fe}$=−0.44 V; $E^o_{Ni^{2+}/Ni}$=−0.25 V) can reduce metal ions with higher reduction potentials, such as silver ($E^o_{Ag^+/Ag}$=0.80 V) and copper ($E^o_{Cu^{2+}/Cu}$=0.34 V) in solution phase. The reduced metallic atoms then grow into nanosize particles in the presence of capping agent through a series of nucleation and kinetic coagulation processes. Unlike traditional homogeneous-phase reduction, here metal ions in solution are reduced on the metal foil surface. Due to inter-molecular forces, the reduced atoms and resulting nuclei and particles have a tendency to accumulate on the foil surface, leading to plating and bulk formation. This physical process prevents the generated nuclei from entering the solution phase and subsequently forming nanoparticles. Severe foil surface coverage from plating and deposition stops the reduction reaction completely and no colloidal particles can be achieved. In the present invention, we engineered a method to overcome deposition, which is inspired by chemical-mechanical planarization (CMP). As illustrated in FIG. 1, we employ a "scrubbing" brush 11 functioning like a "polishing" pad in constant contact with the rotating metal foil or metal plate 12. This soft and hairy brush 11 (can be solid hard brush as well) immediately removes newborn atoms or atom clusters from the foil surface during the reduction process. The brush 11 is held by a holder 13, and is fixed or is placed loosely in a container or reactor 14. The metal plate 12 (or generally a metal element) makes constant contact with the brush 11 under an applied load 15. The solution of reactant 16 can be constantly supplied to the reactor 14, and the product 17 that contains nanoparticles is constantly collected. In addition, turbulent agitation resulting from high-speed rotation of a substrate disk and attached foil in the solution further helps ejecting the particle species from the foil, transferring them into the bulk phase and creating a well-mixed, uniform suspension.

In hydrodynamically and mechanically assisted metal displacement reduction, the mechanical and hydrodynamic forces not only effectively prevent plating and bulk formation by the scrubbing action but also facilitate mass transport and well-mixing, providing more favorable conditions for particle nucleation and growth. Our method in continuous flow also circumvents the intrinsic drawback in the microfluidic reactors-reactor fouling, which is due to the aggregates' settling on the inner surface of the tube wall. For desired size and size distribution, the synthesis is performed similarly to industrial MSMPR (mixed suspension, mixed product removal) crystallizers. The continuous and steady-state operating MSMPR vessel, characterized by a feeding stream of precursor ionic solution and an exit stream of mixed reaction solution, allows regulated control of average residence time of suspended nanoparticles, providing particles with selective growth time and size tunability.

Figure 2:
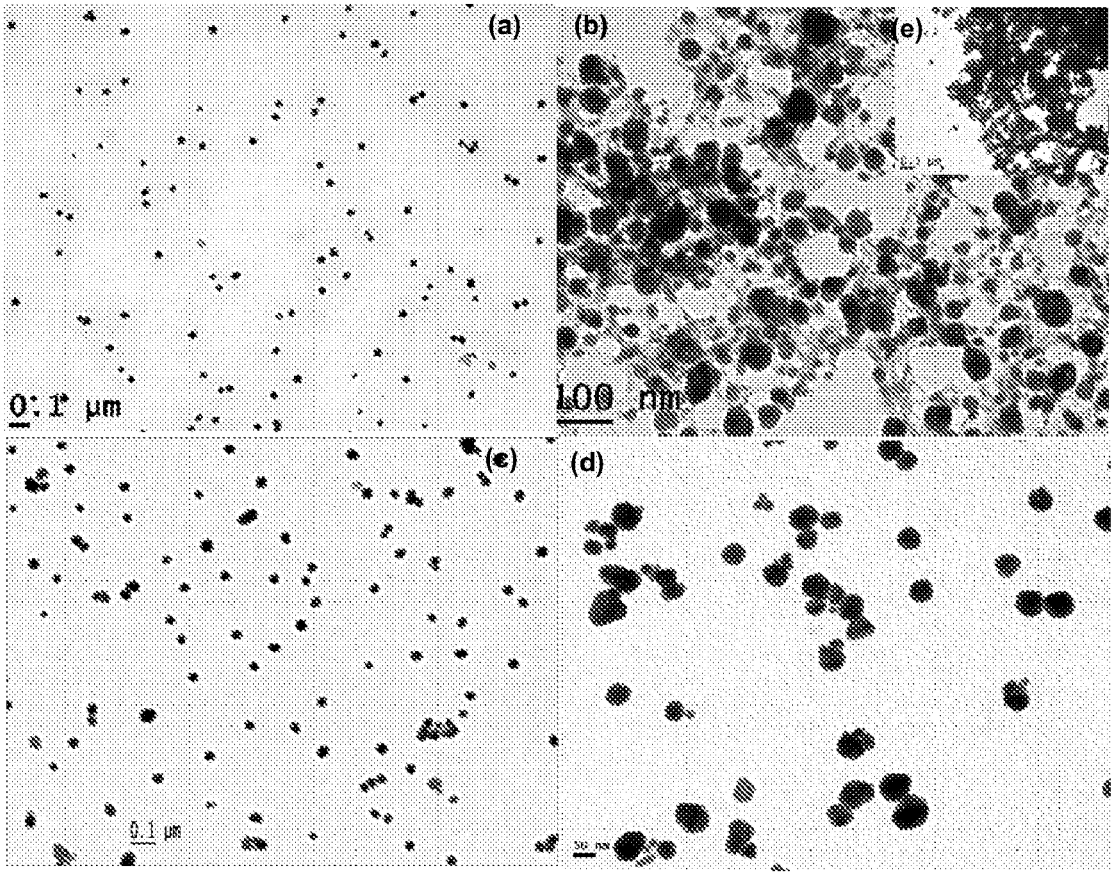
FIG. 2 shows TEM images of Ag nanoparticles synthesized by Ni foil with 0.05M $[Ag^+]$: $\tau$=60 min, (a); $\tau$=120 min, (b); zero flow rate, (e), and by Fe foil at $\tau$=30 min: $[Ag^+]$=0.05 M, (c); and with Co foil with $\tau$=30 min, $[Ag^+]$=0.5 mM, (d). The average sizes are 29.4±5.4 nm, 35.8±9.9 nm, 35.4±6.0 nm and 47.1±11.2 nm (all s.d., n=50) respectively, from 1(a) to 1(d)

As shown in FIG. 2, average size and size distribution can be selectively modulated by particle average residence time ($\tau$) and precursor concentration. For Ni reduction, the increased $\tau$ leads to increased average size and broader distribution from 29.4±5.4 ($\tau$=60 min) to 35.8±9.9 nm ($\tau$=120 min) (FIGS. 2*a* and 2*b*). When reducing the flow rate to zero, as in a batch system, severe agglomeration occurs and almost no individual particle can be identified (FIG. 2*e*). The reason why the average residence time $\tau$ serves as a size and size distribution control strategy is apparent in this specific process; a characteristic "progressive" reduction and nucleation governs the particle formation due to the foils' relatively weak reducing ability compared to strong reducing agent such as $N_2H_4$ and $NaBH_4$, and other factors such as limited reaction sites on the foil surface. Thus nucleation cannot be separated from particle growth in time and the growth durations for individual particles have a distribution with time, and thus a broad size distribution is resulted. Therefore, the average residence time balances the negative effect of progressive nucleation and creates approximately equal particle growth duration although it can not provide absolutely synchronous growth for each particle. Too long average residence time cannot effectively offset progressive nucleation, hence a larger size and broader distribution is obtained with long residence times. With Fe as the reduction agent, the Ag particle size is 35.4±6.0 nm (FIG. 2*c*) with a residence time of 30 min and a concentration of 0.05M. With Co as the reduction agent, the Ag particle size is 47.1±11.2 nm (FIG. 2*d*) with a resicence time of 30 min and a concentration of only 0.5 mM. This shows that the reduction rate plays a more important role in determining the average particle size. Further, it was observed that the slow reduction by using Ni and Fe foils leads to a smaller yield of less than 5%, while the yield with a faster reduction rate (using Co foil) can be much higher (>30%). The effect of the reduction rate implies that the reduction rate is not proportional to the standard potential difference between the metal ion-metal pairs, as $E^o_{Fe^{2+}/Fe}$=−0.44 V<$E^o_{Co^{2+}/Co}$=−0.28 V<$E^o_{Ni^{2+}/Ni}$=−0.25 V.

Figure 3:
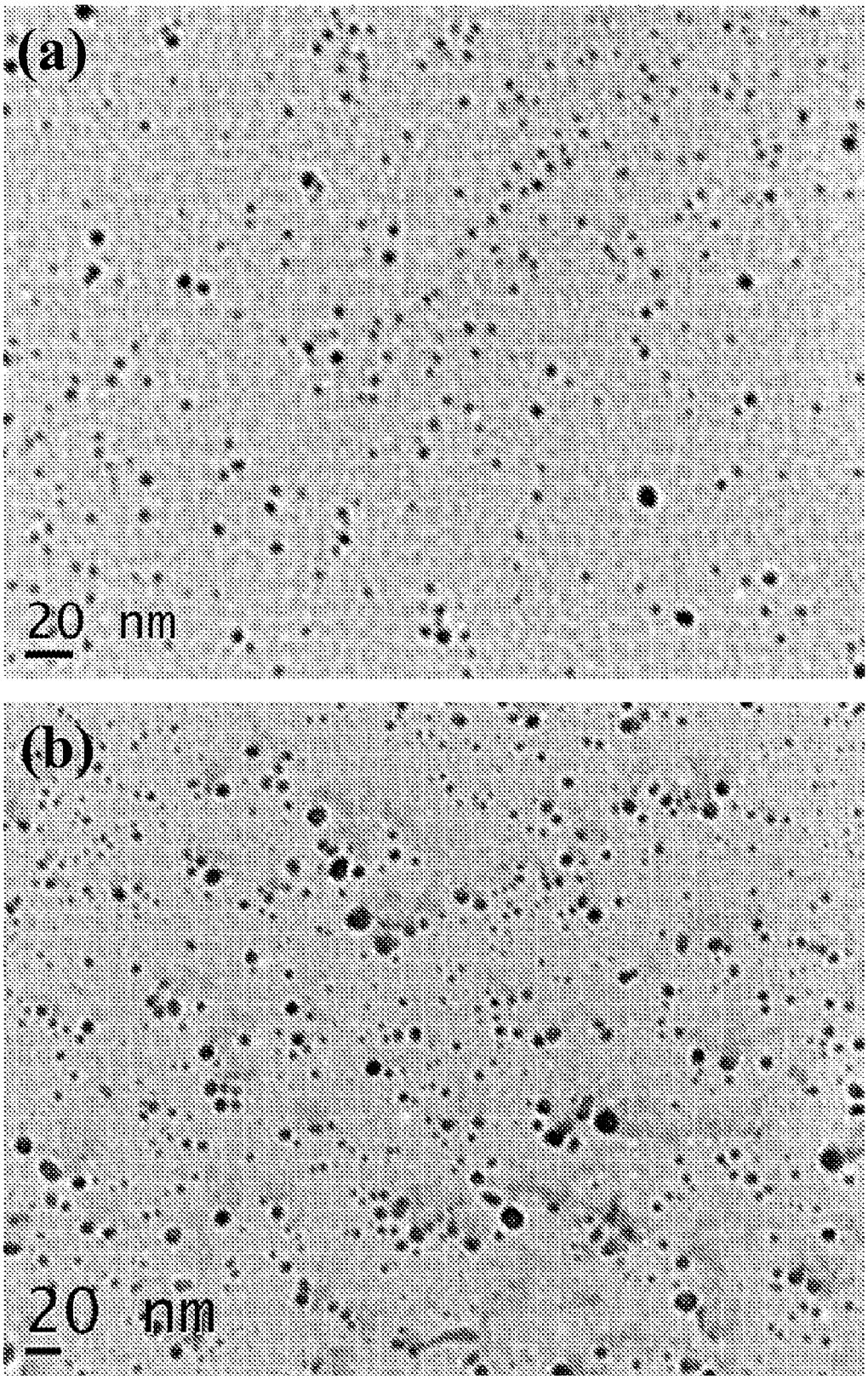
FIG. 3 shows TEM images of Cu nanoparticles synthesized by Co foil with 0.01 M $[Cu^{2+}]$: 4.0±1.1 nm (s.d, n=50), $\tau$=30 min, (a); 4.9±3.1 nm (s.d., n=50), $\tau$=60 min, (b)

FIG. 3 shows another synthesis example: Copper nanoparticle are reduced by Co foil using copper (II) nitrate 2.5-hydrate ($Cu(NO_3)_2.2.5H_2O$, Acros Organics) plus PVP and a fixed molar ratio of [$Cu^{2+}$]/[PVP]=0.2. Under same precursor concentration of [$Cu^{2+}$]=0.01 M, the average size and distribution goes up from 4.0±1.1 ($\tau$=30 min) to 4.9±3.1 nm ($\tau$=60 min). The average residence time is again successfully employed as an adjustment parameter for size selectivity. It should be noted that Co is also an excellent reduction agent, and the yield is approximately 20%.

The second part of the present invention is sonomechanical-assisted-metal displacement reduction (UAMDR). Here metal displacement reduction refers to the spontaneous electrochemical reaction in which a metal ion is reduced to the corresponding zerovalent atom state with the concurrent oxidation of a more electropositive metal placed in the same solution. In order to achieve nanoscale colloids by UAMDR, it is better to select a reducing foil that provides enough-high potential difference between ion-metal pairs. Theoretically, a high pair potential difference would result in rapid reduction, thereby promoting instantaneous nucleation and homogeneous growth. However, there exists a tradeoff, since tremendously quick reduction caused by extremely-high potential difference will result in foil plating. In addition, reduction rate can also be adjusted by varying the concentration of the ionic precursors. The term sonomechanical-assisted refers to that we take advantage of ultrasonic vibrations to successfully overcome plating hindrances and bulk formation. In the synthesis, when atoms are being generated by reduction, ultrasonic vibration effectively ejects them from foil surface into bulk solution and the dispersed atoms nucleate and grow into a uniform nanoscale colloidal suspension. What we need is to dislodge the formed atoms from deposition on the surface of the metal. Ultrasound is a good means to perform just such a function. Under ultrasonication the propagation of pressure waves in solution causes the formation of acoustic microstreaming and acoustic cavitation. The acoustic microstreaming can then dramatically enhance mass transfer at the foil-liquid interface by reducing the ionic concentration gradient. The extreme high temperature and pressure inside the cavitation bubbles initiate the formation of reducing free radicals, which are responsible for the sonoreduction. Collapsing or imploding of the bubbles creates physical effects such as shear forces and shock waves and the formation of liquid jets. All these effects help to impinge and pit against the foil surface through a scrubbing action to dislodge the particles so as to prevent bulk formation.

Figure 4:
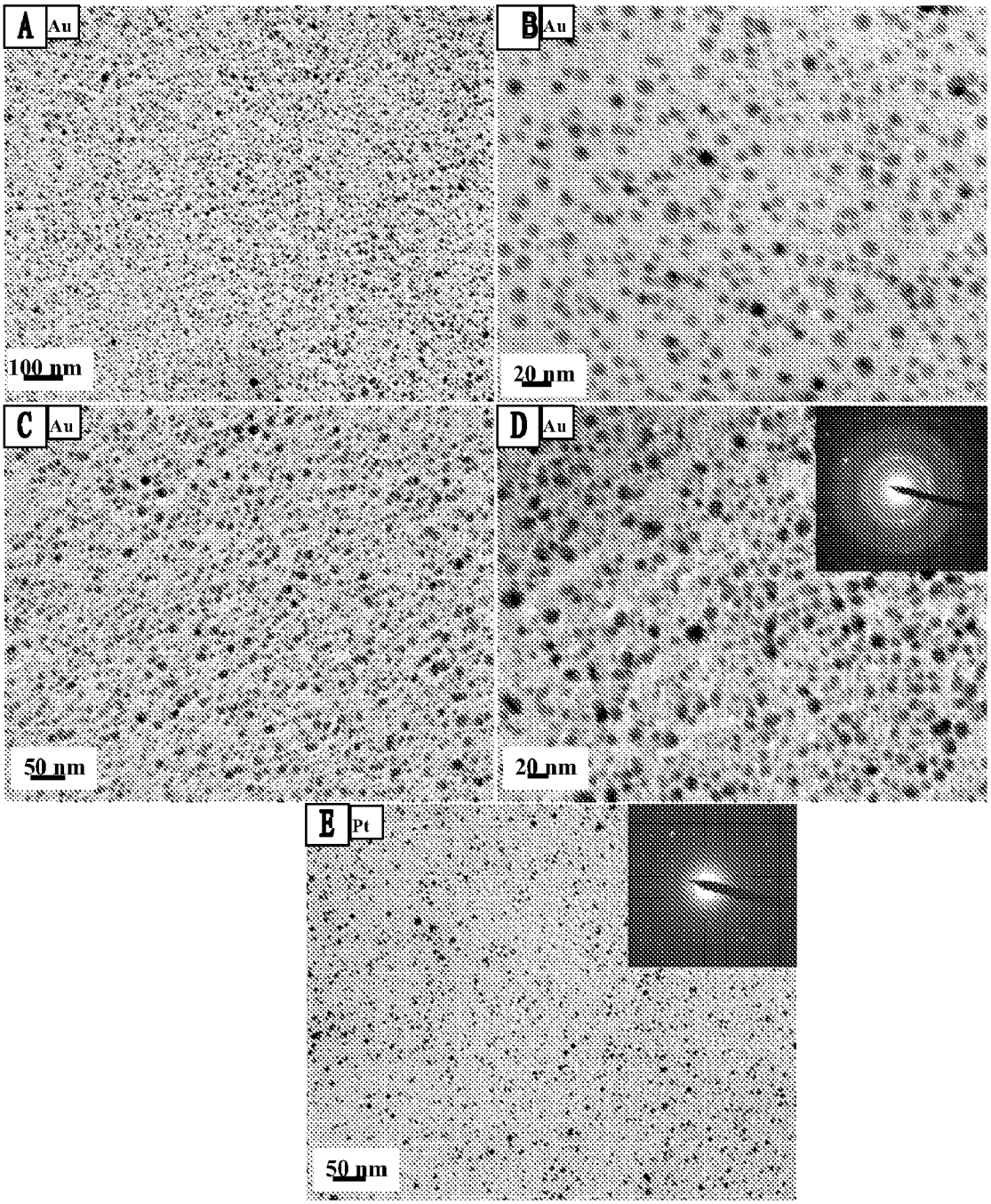
FIG. 4 shows TEM images and electron diffraction patterns of Au and Pt nanoparticles in typical syntheses: A) and B) Au, 5 minute sampling with 100 nm and 20 nm scale bars, respectively; average particle size around 10 nm, with good monodispersity. C) and D) Au, 10 min sampling, with 50 nm and 20 nm scale bars, respectively; relatively broad size distribution. E) Pt, 5 min sampling with 50 nm scale bar; average size around 6 nm with good monodispersity.
Figure 5:
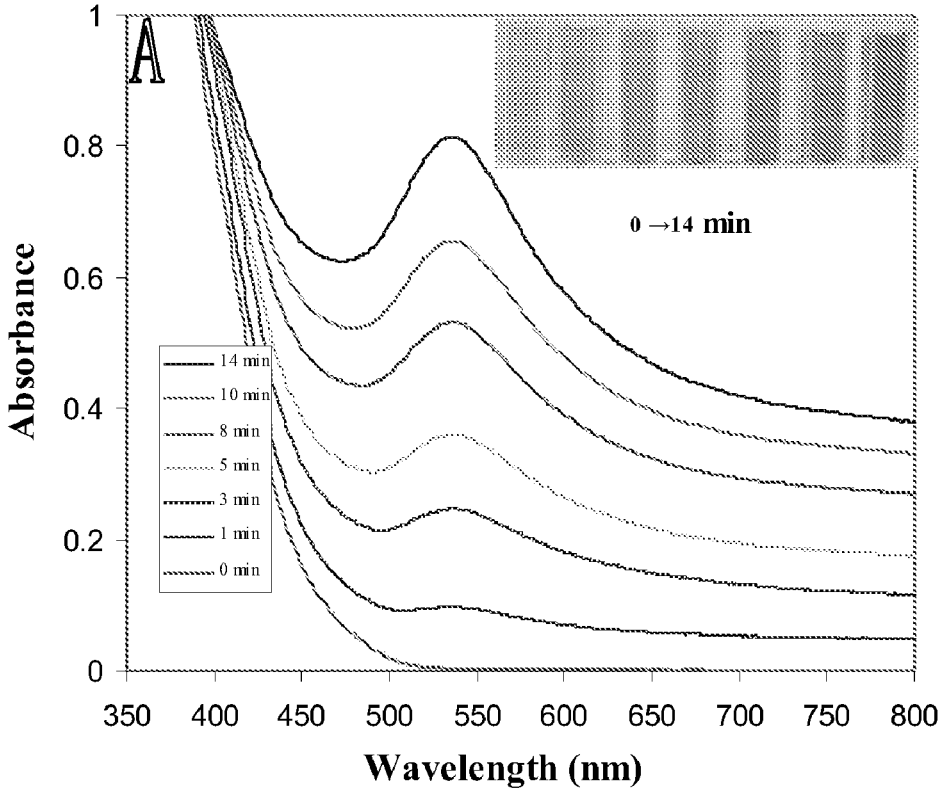
FIG. 5 shows UV-Vis absorption spectra of Au nanoparticles colloid sampled at different reaction stages by reducing 0.0025 M $HAuCl_4$ aqueous solutions in 42 kHz continuous ultrasonic cleaner at room temperature and in ambient condition: (A) in presence of Cu foil as a heterogeneous reducing medium; (B) in absence of Cu foil (solely ultrasonication)
Figure 5:
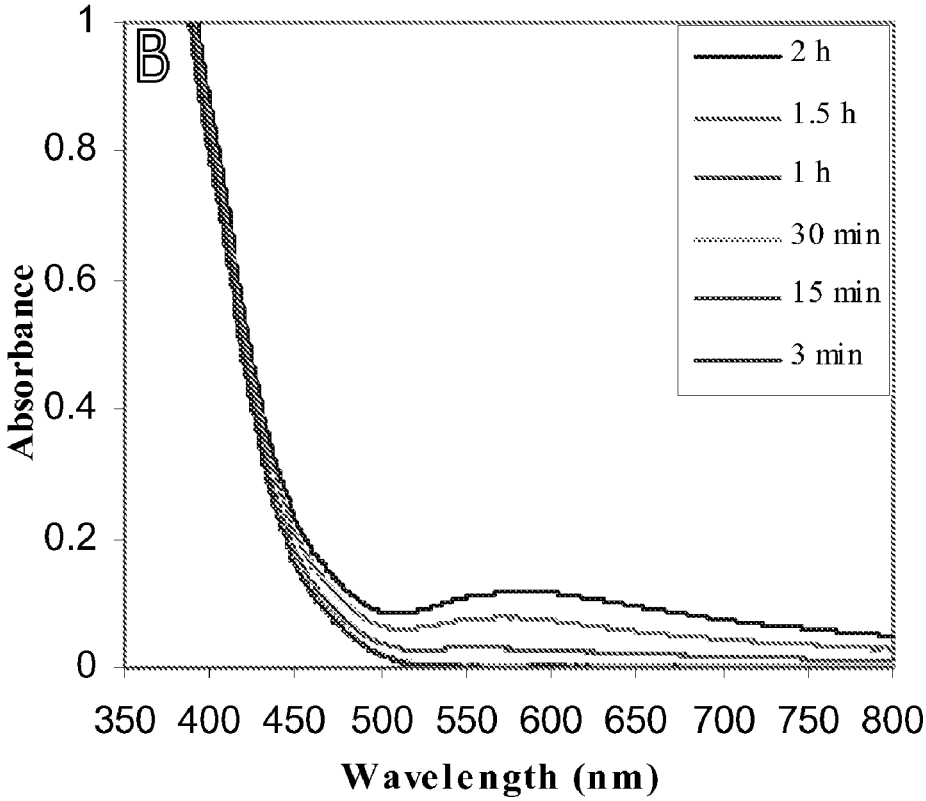

In a typical synthesis, upon of placing the metal foils into the ultrasonicating precursor solutions, observable nanoparticle slurry streams are ejected from the foil surface into the bulk solution within a few seconds, and in a couple of minutes, the bright red/purple Au and grey Pt nanoparticle colloids are achieved. Only minor plating for Cu foil and almost no plating for Fe foil occur when using them as the heterogeneous reducing media for Au and Pt nanoparticles respectively. FIG. 4 shows TEM images of Au and Pt colloidal samples taken from typical synthesis, in which $HAuCl_4$ and $H_2PtCl_6$ were reduced on the surface of the Cu and Fe foils respectively in the presence of poly(vinylpyrrolidone) (PVP) as a capping agent. FIGS. 4A and 4B are Au colloid samples taken after 5 min reaction. Clearly a high content of nanoparticles with mean size around 10 nm and good monodispersity is achieved in short time. The uniform size distribution can be attributed to the fast reduction induced instantaneous nucleation, that is, for a short time interval relative to the duration of particle growth. Furthermore, the hetero-sites on the foil surface and the limited nucleation region promote instantaneous nucleation. With further reaction time, the newly "polished" atoms and nuclei in the vicinity of the foil surface begin to take part in kinetic collisions and aggregate with those species in the bulk solution phase, resulting in a relatively broad size distribution (FIGS. 4C and 4D). FIG. 4E shows TEM image and electron diffraction pattern of Pt nanoparticles with average size around 6 nm acquired after 5 min reaction time.

An important property of some nanoparticle colloids is the surface plasmon resonance (SPR), the frequency at which conduction electrons oscillate and scatter/absorb the incident electromagnetic waves. Only metals with free conduction electrons (essentially Au, Ag, Cu, and the alkali metals) possess plasmon resonances in the visible spectrum, which give colloids different intense colors. FIG. 5A shows the UV-Vis spectra of Au nanoparticle colloids at different reaction stages, with the characteristic maximum absorbance at around 530 nm. The absorbance peak intensifies with increased reaction time, indicating an increase in the particle content. In order to investigate the sonochemical reduction effect, a reference experiment was performed in absence of Cu foil. No color change of the solution was observed in up to 2 hours of ultrasonication. FIG. 5B shows weak and broad SPR absorption around 580 nm after 1.5 hours of sole ultrasonication, which is probably due to the sparse nanoparticle content and wide size distribution owing to little amount of free radicals produced and slow reduction rate in the weak-intensity ultrasonic bath. This clearly confirms the overwhelming function of Cu foil as a heterogeneous reducing medium for the formation of Au colloids rather than ultrasound induced free radicals.

Figure 6:
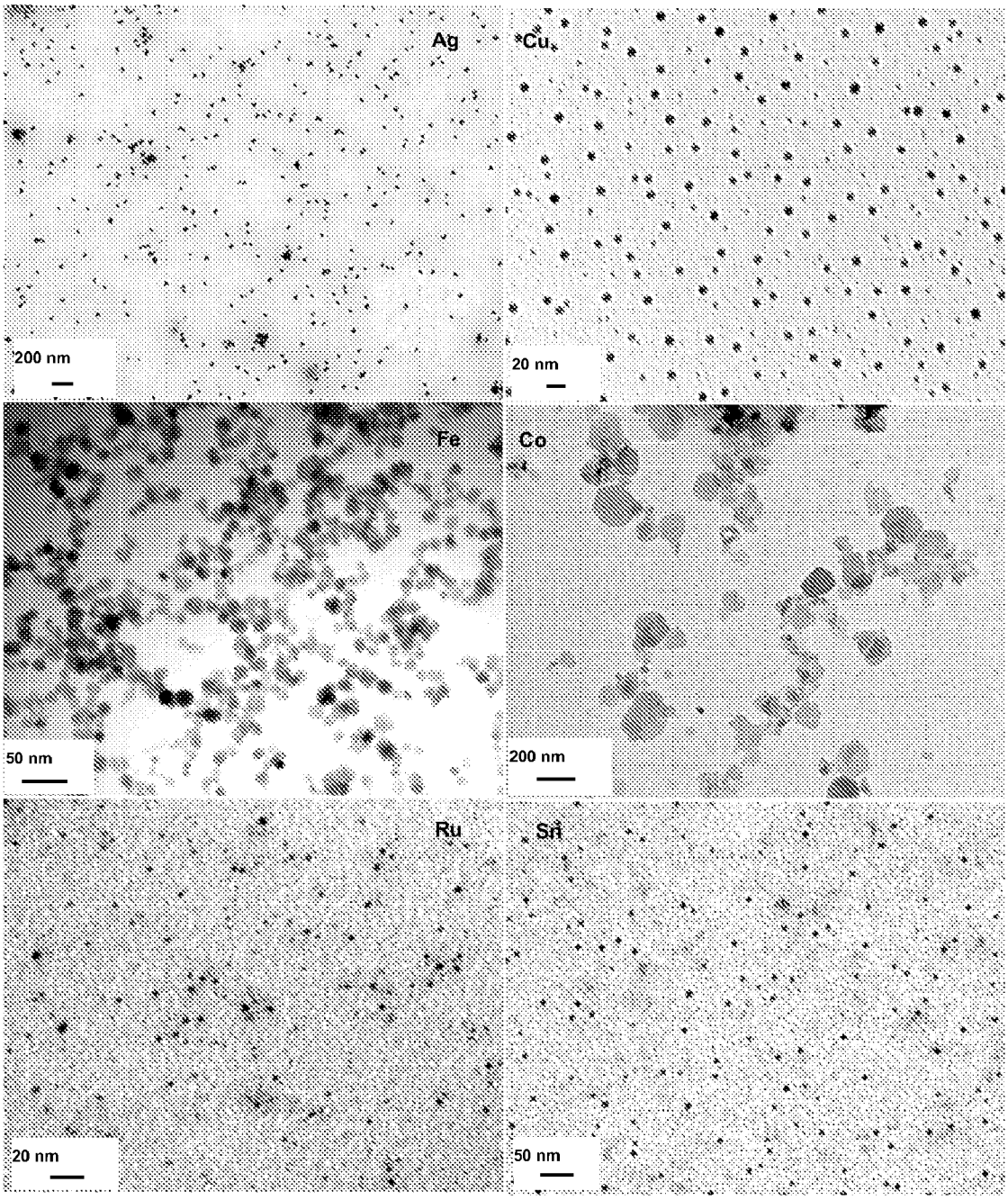
FIG. 6 shows TEM images of various nanoparticles synthesized by UADMR. Colloids were sampled at 6 minutes for Fe and Co, 5 minutes for Cu and Sn and 4 minutes for Ag and Ru. The obtained colloids were then centrifuged and washed with ethanol.
Figure 7:
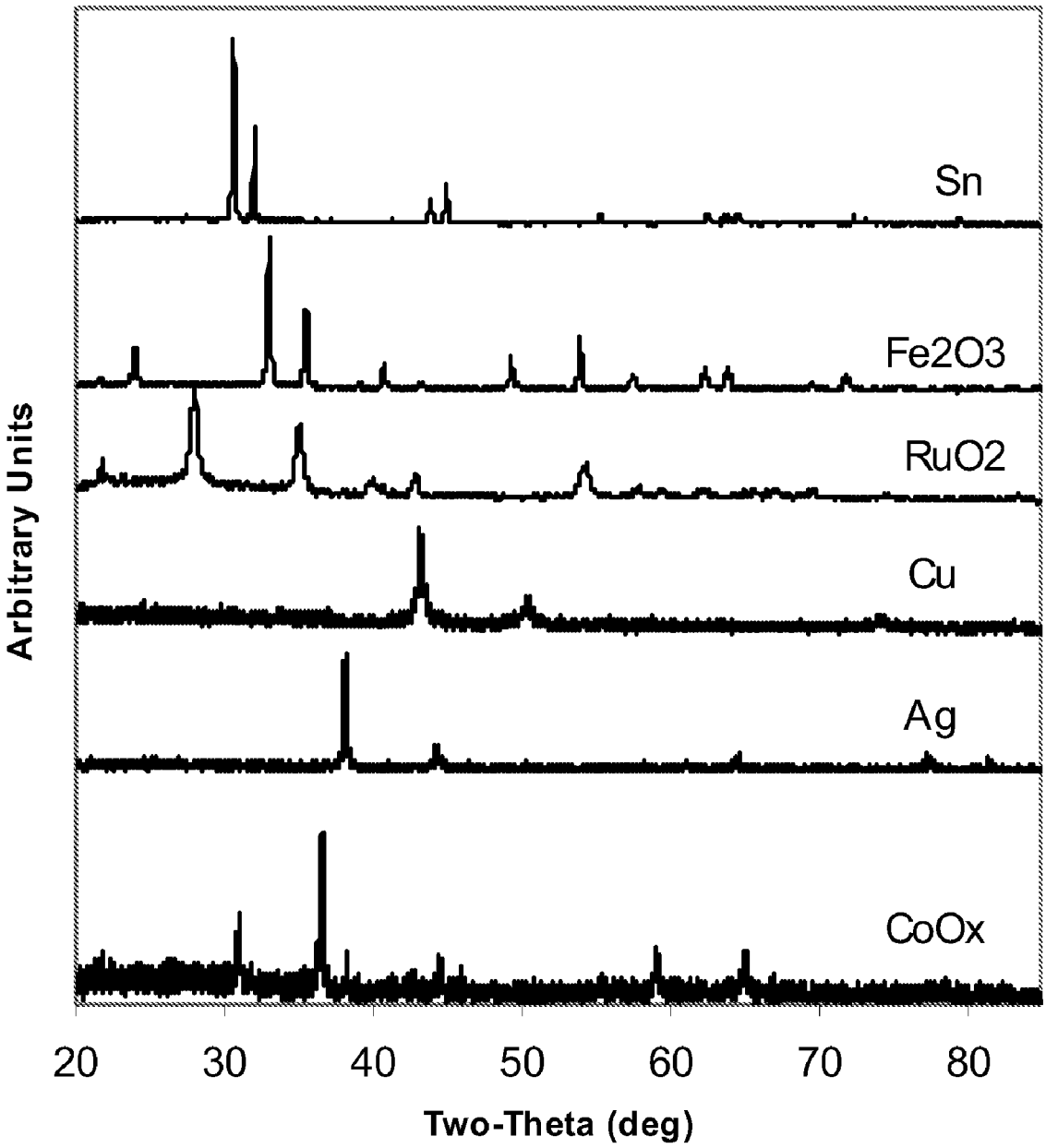
FIG. 7 shows XRD patterns of various nanoparticles synthesized by UADMR. Oxides form for Fe, Co and Ru after annealing for 6 hr. at 700° C. under argon.

Optimal pairs for nanoparticles synthesis also have been determined based on experimental observation and microscopic characterization. FIG. 6 shows a series of metallic nanoparticles synthesized by UAMDR. The TEM (Philips CM12, 100 kV accelerating voltage) images show as-synthesized particles of Ag, Cu, Fe, Co, Ru and Sn. The particle sizes obtained from TEM are 51.7±6.4 nm, 7.8±1.5 nm, 14.4±1.8 nm, 124.0±47.9 nm, 3.1±0.9 nm, 7.9±1.7 nm for Ag, Cu, Fe, Co, Ru and Sn (all in s.d., n=50) respectively. Aside from Co, all the colloidal solutions have relatively narrow size distribution. The synthesized particles may not be in spherical shape, and therefore an equivalent diameter is taken. The XRD patterns of the as-synthesized Fe, Co and Ru show amorphous structures, which is consistent with most of the reported literature. These particles were annealed at 700° C. under argon for six hours before obtaining crystalline XRD patterns. It must be pointed out that oxygen could possibly penetrate the annealing cell and the Fe, Co, and Ru nanoparticles could be oxidized either during annealing or during the ambient synthetic process; the obtained XRD patterns are assigned as $Fe_2O_3$, $CoO_x$ (representing a mixture of CoO, $CO_2O_3$, $CO_3O_4$) and $RuO_2$. FIG. 7 shows all the XRD (Rigaku D/Max-B, nickel filtered Cu Kα radiation, 35 kV accelerating voltage and 30 mA flux) patterns of synthesized nanoparticles. No signs of element contamination from the reducing foils were found. The calculated crystalline/grain sizes based on the Scherrer formula are 52.3, 18.6, 37.5, 32.5, 22.3 and 45.4 nm for Ag, Cu, $Fe_2O_3$, $CoO_x$, Ru and Sn, respectively. A sintering aggregation may occur during the annealing process for $Fe_2O_3$ and Ru nanoparticles, whose grain sizes greatly increase in contrast to those of as-synthesized samples.

Figure 8:
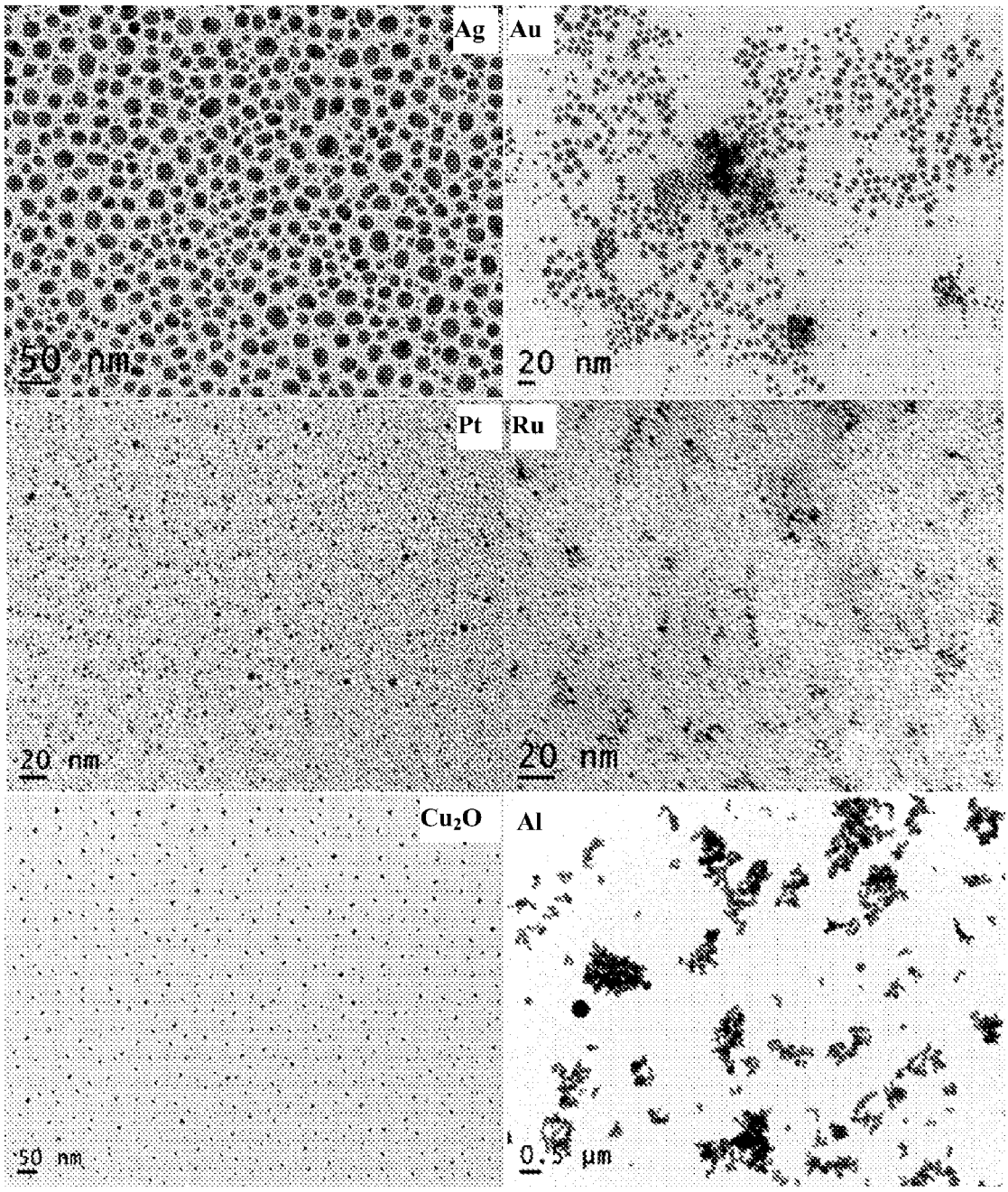
FIG. 8 shows TEM images of silver, gold, platinum, ruthenium and cuprous oxide nanoparticles and the reducing medium of aluminum powder, with average size of 18.2, 8.9, 2.4, 2.5, 8.8 and 150 nm, respectively.
Figure 9:
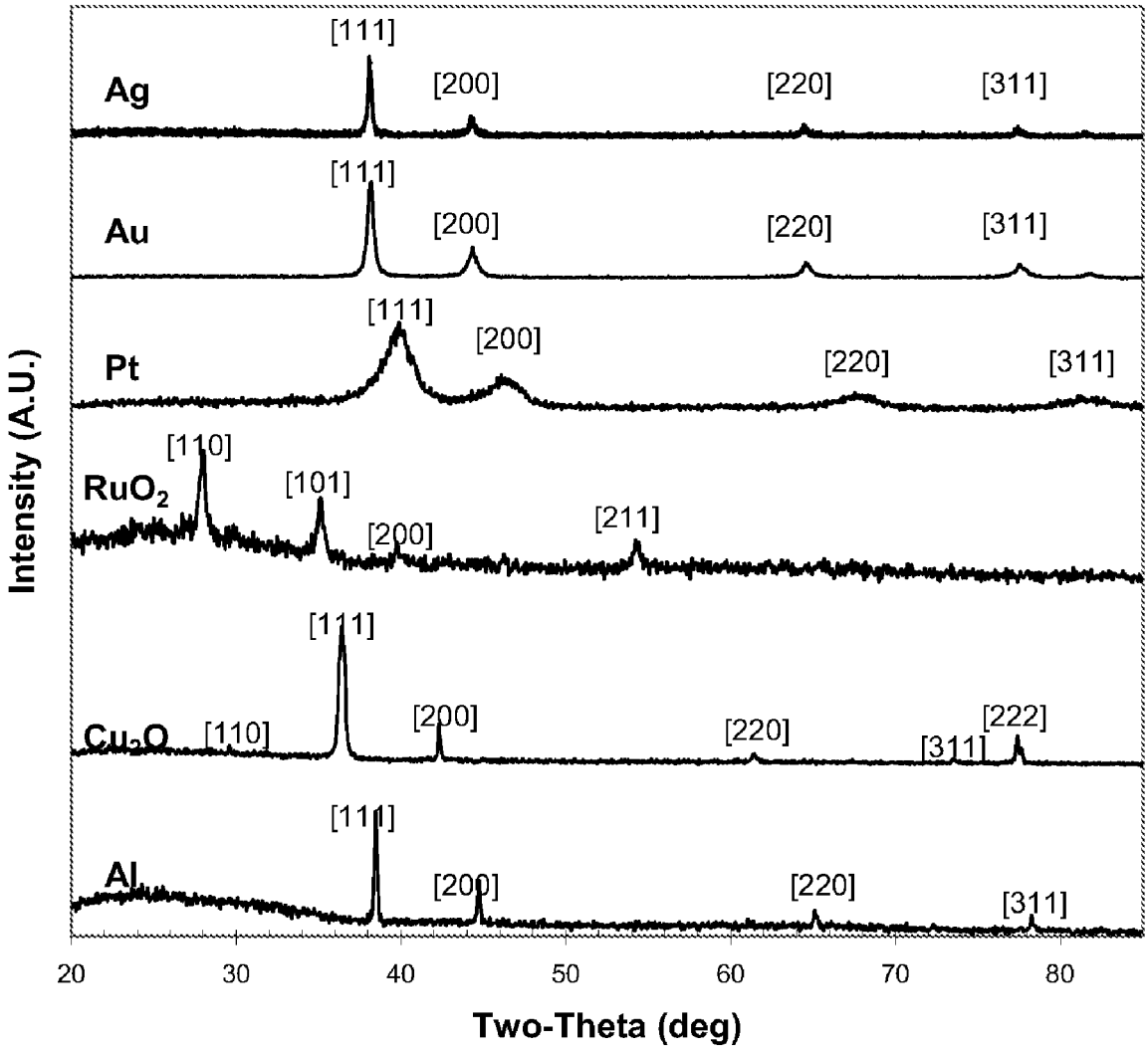
FIG. 9 XRD patterns of produced silver, gold, platinum, ruthenium oxide (after heat treatment), cuprous oxide nanoparticles and the reducing medium of aluminum powder.

The invention of UAMDR also includes using metal powder as heterogeneous sacrificial reducing template to prepare various metallic and oxide nanoparticles such as Au, Ag, Pt, Ru and $Cu_2O$ with excellent monodispersity. Through the aid of ultrasonic vibration-induced physical effects such as acoustic cavitation and microstreaming, metallic atoms or clusters, when reduced, are immediately dislodged from Al particle surface into bulk solution phase, avoiding the strong tendency of surface deposition and formation of core-shell structures. In a relatively short period of time, a large amount of atomic species grow into nanoscale particles via instantaneous nucleation and subsequent coalescence in the presence of capping agent, and a uniform size distribution results. FIG. 8 shows typical TEM images of as-synthesized nanoparticles of silver, gold, platinum, ruthenium and cuprous oxide with the average diameter of 18.2, 8.9, 2.4, 2.5, and 8.8 nm, respectively, and with good uniformity. Copper is spontaneously oxidized under the ambient synthetic condition to the oxidic form of $Cu_2O$, which is evident from XRD characterization (FIG. 9). It should be noted that the pure elemental Cu nanoparticles could be produced by this method given an oxygen-deprived condition including solution deoxygenation and inert gas protection. The image of the starting material of aluminum powder shows that the particles appear in the shape of incompact aggregate network made up of individual spherical particles with size range of 100-200 nm. These unconsolidated structures can be broken up by ultrasonic vibration during the syntheses to promote well-dispersed independent particle suspension, making each particle an excellent single-solid reducing medium. For all of the nanoparticle samples, no core-shell structures are observed, indicating the perfect dislodging effect of ultrasonication.

Figure 10:
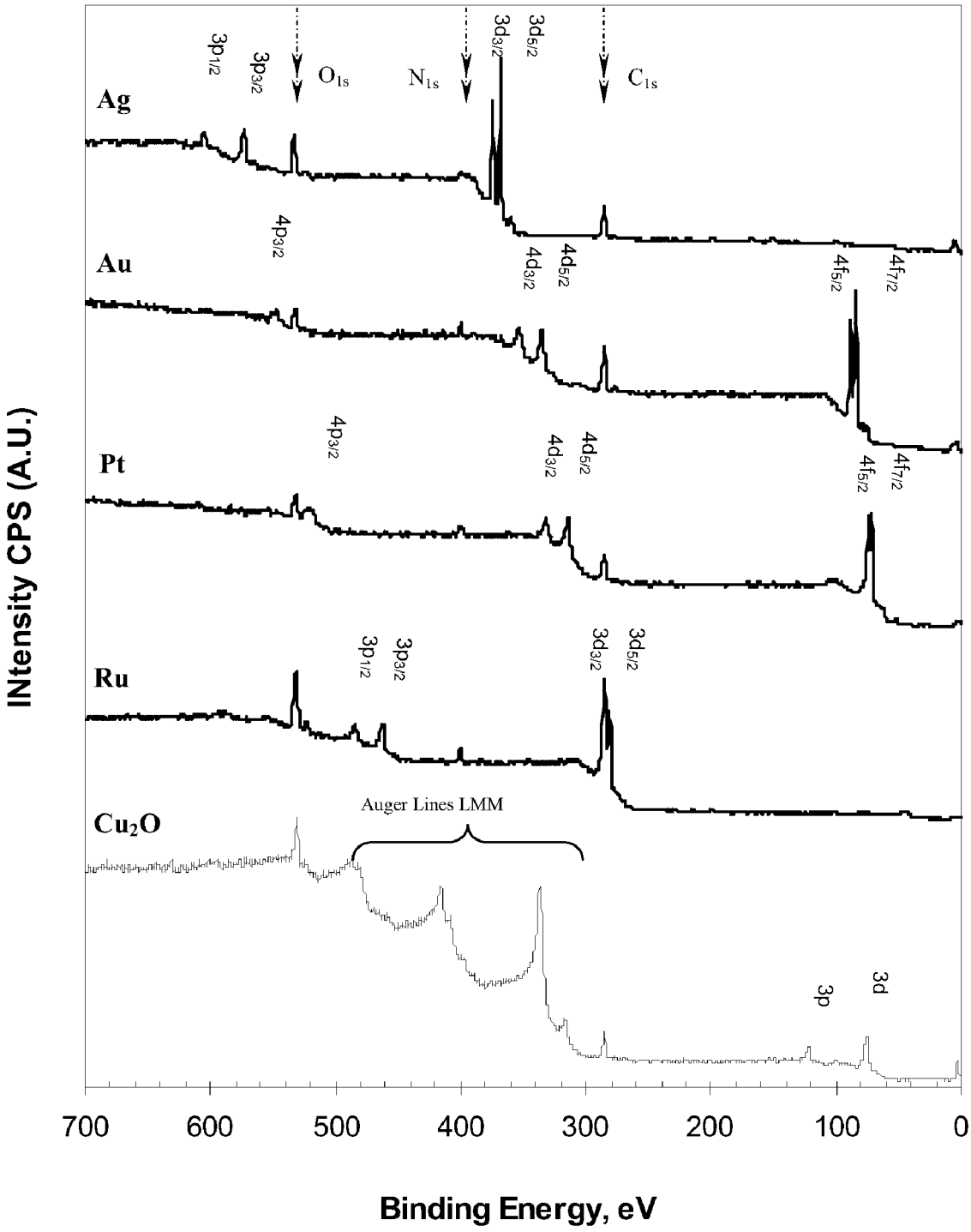
FIG. 10 XPS spectra of produced poly(vinylpyrrolidone) (PVP)-capped silver, gold, platinum, ruthenium and cuprous oxide nanoparticles by using the reducing medium of aluminum powder.

FIG. 9 exhibits XRD pattern of each produced nanoparticle species and the starting reductant of aluminum powder. Each diffraction peak corresponding to specific crystalline plane is designated for each species and compared with standard patterns for crystal structures verification, confirming the successful synthesis of face-centered cubic (fcc) structured Ag (JCPDS 4-783), Au (JCPDS 4-784), Pt (JCPDS 4-802) and cubic $Cu_2O$ (JCPDS 5-667). The as-synthesized ruthenium shows amorphous structure and a crystalline tetragonal $RuO_2$ (JCPDS 40-1290) was obtained and identified after annealing at 600° C. under argon atmosphere for five hours. XRD pattern also confirms the high-purity and fcc structured Al (JCPDS 4-787) powders used with no oxidization. In each sample, no characteristic peaks of aluminum are detected, negating the existence of residual or wrapped elemental Al. Since the diffraction peaks of Au (2θ=38.2, 44.4, 64.6, 77.7 and 81.8 degree), Ag (2θ=38.2, 44.3, 64.5, 77.5, 81.6 degree) and Al (2θ=38.5, 44.8, 65.2, 78.3 and 82.5 degree) are indistinguishable, XPS was used to confirm the formation of pure Au and Ag. FIG. 10 shows the XPS survey spectra of all the produced metallic species with major photoelectron peaks assigned and all the binding energies are referenced to $C_{1s}$ (285.0 eV). Each spectrum reveals the existence of C, N and O, which are derived from the capping layer of PVP around the nanoparticles. No binding energy peak of the strongest $Al_{2p}$ at 73.0 eV was detected in any samples including Au and Ag.

Figure 11:
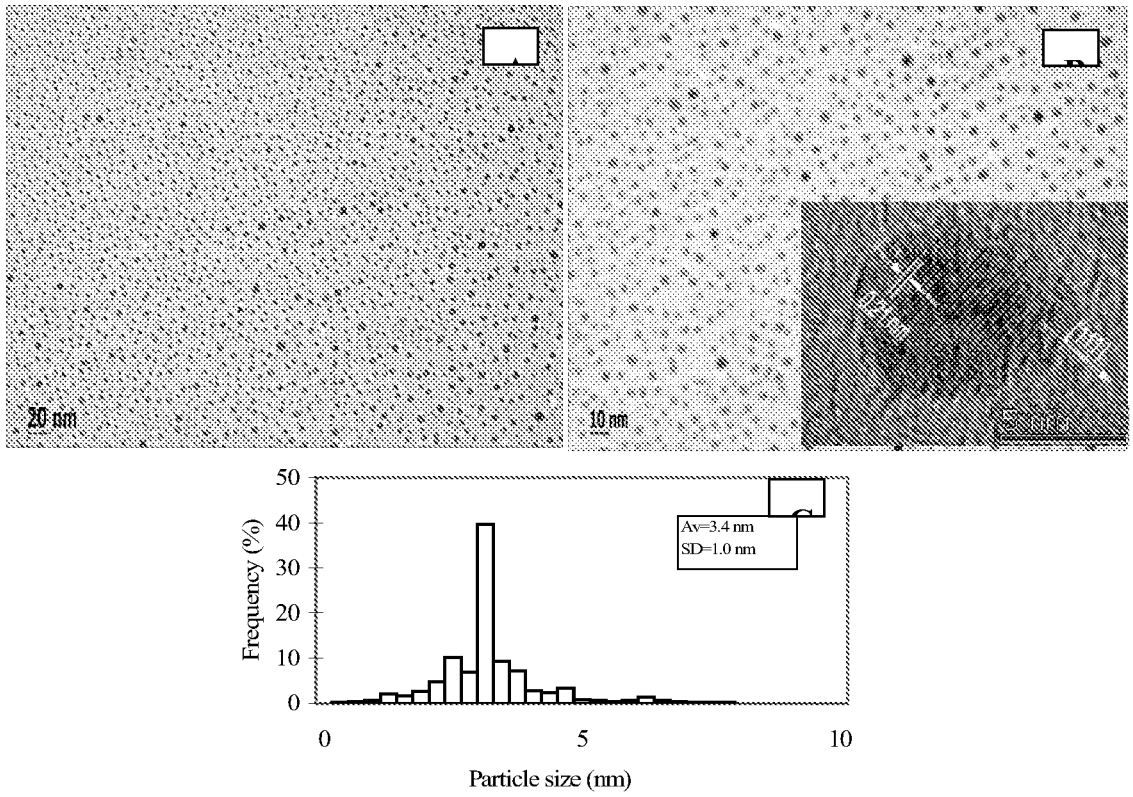
FIG. 11 shows TEM images, (A) and (B) of PVP stabilized copper nanoparticles and a histogram, (C) of particle size distribution based on (A) (average particle diameter=3.4 nm and standard deviation=1.0 nm). Totally counted number of particles is 729.

The third part of the present invention is a total "green" chemical method in aqueous solution for synthesizing stable narrowly dispersed copper nanoparticles with an average diameter of less than 5 nm in the presence of Polyvinylpyrrolidone (PVP) as a stabilizer and without any inert gas protection. It's known that pure iron, cobalt and nickel nanoparticles are very difficult to synthesize due to their high chemical activity. Copper, which is less active than iron, cobalt and nickel, and more active than noble metals such as Ag and Au, is not easily produced via reduction of precursor salts, even in the presence of protecting/capping agents. In our synthesis route, ascorbic acid, natural vitamin C (VC), an excellent oxygen scavenger, acts as both reducing agent and antioxidant, to reduce the metallic ion precursor, and to effectively prevent the common oxidation process of the newborn pure copper nanoclusters. So even when our synthesis routine was performed without deoxygenated solution and without inert gas protection, pure Cu nanoparticles were obtained. FIG. 11 shows TEM images of as-synthesized copper nanoparticles in the typical experiment with different scale bars and histogram of particle size distribution with respect to FIG. 11A. The TEM images exhibit a high concentration of copper nanoparticles composed of nearly spherical, small-sized particles with very narrow size distribution. The fringes in the HRTEM (inset of FIG. 11B) are separated by 0.21 nm, which agrees with the [111] lattice spacing of fcc copper. The histogram reveals an average particle diameter of 3.4 nm, standard deviation of 1.0 nm and relative standard deviation of 0.294. About 92.9% of the total particles are in the range of 1.3-4.7 nm, and 78.2% of the total are in the range of 2.2-3.7 nm, indicating a nearly monodisperse distribution. The weight or volume fraction of the nanoparticle dispersion will be determined in the future for nanofluidics study. PVP was also verified as an ideal candidate for stabilizing and controlling the copper nanoclusters growth. Although the fundamental mechanism has yet to be fully understood, it is believed that PVP can coordinate to the particles surface via O—Cu coordination bond and wrap around the particles with its long and soft polyvinyl chain to stop their growth and aggregation toward bulk particles.

Figure 12:
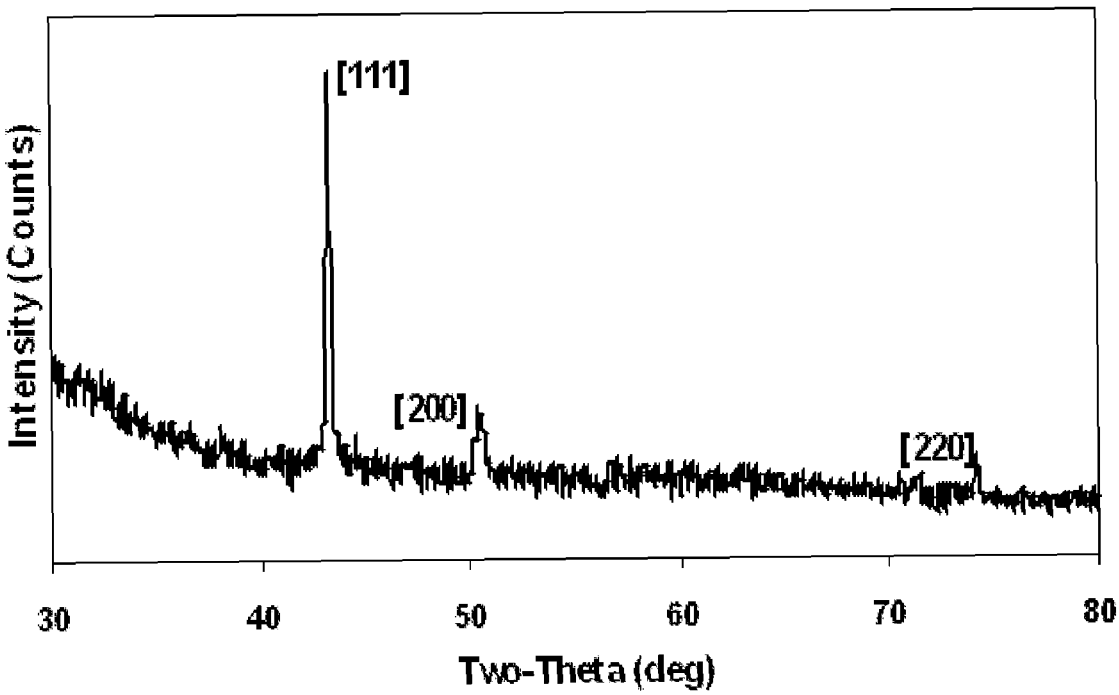
FIG. 12 shows XRD pattern of copper nanoparticles.
Figure 13:
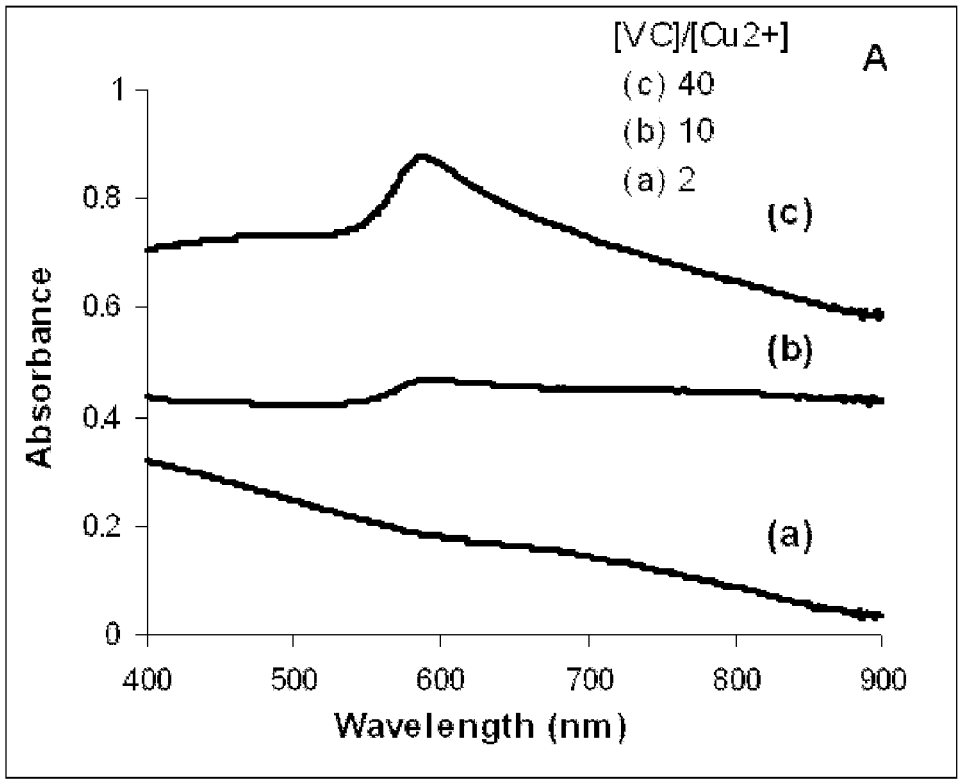
FIG. 13 shows UV/vis absorption spectra of as-synthesized copper nanoparticle colloids at various [VC]/[$Cu2^+$] and [PVP]/[$Cu2^+$].
Figure 13:
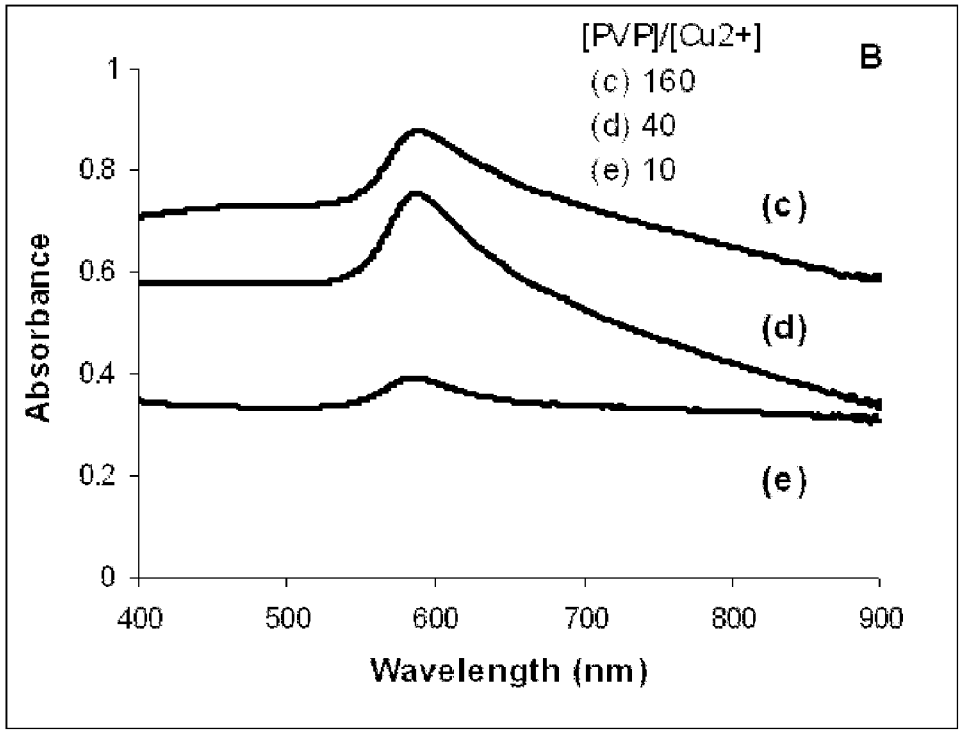

The XRD spectrum of the as-synthesized copper nanoparticles in the typical experiment is shown in FIG. 12. Three main characteristic diffraction peaks for copper at 2θ=43.2, 50.4 and 74.0 degree, corresponding to (111), (200) and (220) crystal planes respectively are observed. This confirms the formation of pure fcc copper nanoparticles. UV/Vis response of the colloid obtained from the typical experiment (0.01M $[Cu^{2+}]$ and 0.8M [PVP]+0.4M [VC] and 0.8 M [PVP], $[VC]/[Cu^{2+}]=40$, $[PVP]/[Cu^{2+}]=160$) is shown by pattern (c) in FIGS. 13A and B. We did a series of experiments with different $[VC]/[Cu^{2+}]$ ratio and $[PVP]/[Cu^{2+}]$ ratio as shown in (a), $[VC]/[Cu^{2+}]=2$, and (b), $[VC]/[Cu^{2+}]=10$, and different $[PVP]/[Cu^{2+}]$ ratio as shown in (d), $[PVP]/[Cu^{2+}]=40$, and (e), $[PVP]/[Cu^{2+}]=10$. As can be seen from FIG. 13A, when $[VC]/[Cu^{2+}]=40$, the copper colloid displays a sharp and narrow characteristic absorption peak at 587 nm, which can be assigned to the surface plasmon resonance absorption of pure copper nanoparticles with size effect. Further decreasing the ratio to 10 (FIG. 13A, b) and 2 (FIG. 13A, a), the plasmon bands show broadening and tailing toward longer wavelengths, which indicates the presence of copper oxides. And also this oxidation can be further confirmed from the colors of the colloids, which are red, burgundy and grey blue for case (c), (b) and (a) respectively. The ratio of $[PVP]/[Cu^{2+}]$ also plays an important role in controlling the size, size distribution and morphology of the nanoparticles.

The present invention provides a facile and environmentally friendly process for preparing monodisperse nanoparticles of most transition metals as well as their alloys and oxides in three different methods. As illustrated in the examples below,

EXAMPLE 1

As an example of the synthesis strategy, silver nitrate (AgNO3, anhydrous, 99.9+%, Alfa Aesar) is mixed with polyvinylpyrrolidone (PVP, weight-average molecular weight of 58K, Acros Organics) in deionized water at room temperature at various reported concentrations. Nickel foil, iron foil, and cobalt foil (all 0.5 mm thick, 50×50 mm, Alfa Aesar) are employed as a heterogeneous reducing medium respectively for the generation of silver nanoparticles in the reactor. The molar ratio of AgNO3/PVP (in repeating unit) is fixed at 1:1 for Ni and Fe reduction and 10 for Co reduction.

The AgNO3/PVP solution is put into the reaction vessel (150 ml in vessel) and an inlet reservoir. The volume of reaction solution remains constant at 150 ml during the whole procedure because of the balanced input and exit volumetric flow rate. The foil, immersed in the solution, rotates at high speed together with the substrate holder, and a hairy brush fastened to the vessel bottom remains in constant contact with the foil surface to perform the polishing function. The inlet flow is controlled through a funnel and the exit flow is controlled by a plastic tube with a regulatory clamp. After steady flow state is reached (usually 1~2 average residence time), solution mixture was sampled for further characterization and analysis.

The concentration of the metal salt precursor, the flow rate and thus corresponding particle average residence time (due to fixed balance volume), were investigated as critical regulatory factors for particle dimension and distribution control. FIG. 2 shows TEM images of synthesized Ag nanoparticles reduced by Ni, Fe and Co foil at varied flow rate and at varied precursor concentrations.

EXAMPLE 2

In the typical synthesis, 100 ml solution of 0.0025 M HAuCl4.3H2O (Alfa Aesar, 99.99%) or 0.0025 M H2PtCl6.6H2O (Alfa Aesar, 99.9%), and 0.05 M (in repeating unit) Polyvinylpyrrolidone (PVP, K29-32, molecular weight=58000, Acros Organics) in distilled water was placed in a 600 ml uncovered beaker. The beaker was then put into an ultrasonic cleaner (Fisher Scientific, FS20H, continuous mode, 70 W output and 42 kHz, 2.8 L of tank volume and dimension (interior) D×W×H of 14×15.2×15.2 cm) tank with 400 ml tap water (beaker contacting bath bottom). The ultrasonication cleaner was turned on when the copper foil (1.0 mm thick, 50×50 mm, 99.99%, Alfa Aesar) or iron foil (0.5 mm thick, 50×50 mm, 99.99%, Alfa Aesar), was placed in the solution. The beaker was occasionally swirled by hand during the reaction while keeping the upper level of reaction solution below the water level of the bath. The whole process was performed at room temperature and in ambient condition. There was no observable temperature change of the water bath and the reaction solutions during the experiments. Solution samples were collected at different reaction times. The collected solution samples were immediately examined by UV-Vis (Cary 3E spectrophotometer). The collected solution samples were also centrifuged and washed with ethanol several times. These samples were characterized by TEM (Philips CM12, 100 kV) and XRD (Rigaku D/Max-B, nickel filtered Cu Kα radiation, λ=1.54056 Angstrom).

EXAMPLE 3

A sample synthesis of the UAMDR is: 0.02 M of metal salt precursor, either copper (II) chloride dihydrate (CuCl2.2H2O, 99%, Acros Organics), iron (II) chloride (FeCl2, anhydrous, 99.5%, Alfa Aesar), cobalt (II) chloride hexahydrate (CoCl2.6H2O, 99.9%, Alfa Aesar), ruthenium (III) chloride hydrate (RuCl3.xH2O, 35-40% Ru, Acros Organics), or Tin (II) chloride (SnCl2, anhydrous, >99%, Alfa Aesar) or 0.01 M of silver nitrate (AgNO3, 99.9+%, Alfa Aesar) is mixed with polyvinylpyrrolidone (PVP, weight-average molecular weight of 58000, Acros Organics) in 100 ml deionized water or ethylene glycol (particularly for Sn nanoparticles preparation due to the hydrolysis of Sn2+ in water). The metal salt/PVP solution (molar ratio of 1/10, molar concentration of PVP is determined by the repeating unit) is put into a 500 ml beaker and then placed into the vessel of an ultrasonic cleaner (Fisher Scientific, FS20H, 70 W output and 42 kHz) with water. Cobalt foil (0.5 mm thick, 50×50 mm, 99.95%, Alfa Aesar) is employed for synthesis of Ag nanoparticles, aluminum foil (0.5 mm thick, 50×50 mm, 99.99%, Alfa Aesar) for Cu and magnesium foil (1.0 mm thick, 50×50 mm, 99.9%, Alfa Aesar) for Fe, Co, Ru and Sn. The reaction starts when metal foils (polished with 320 grit ultrafine sandpaper to remove possible oxide layer on the surface) are placed in the sonicating solution. Due to the effective ultrasonic deplating, a relatively clean and smooth foil surface is maintained during the process, although slight plating or deposition is unavoidable. Colloidal solution samples were collected at different reaction times. The solid powders of the nanoparticles were obtained through centrifuge (20 minutes at 8000 rpm) and washing with ethanol (40 ml for each time) for several cycles. The isolated particles can be easily redispersed in water or ethanol to form stable colloidal solutions.

EXAMPLE 4

As a example, 20 ml deionized aqueous solution of 0.02 M Ag, Au, Pt, Ru or Cu precursor salt and 0.1 M PVP was first prepared in a 50 ml polypropylene centrifuge tube with closed top. For each synthesis, according to the specific chemical reaction, a half of stoichiometric quantity of Al powder was added to avoid Al powders residue. The tube containing the solution and reactants was immediately put into the ultrasonic cleaner with 400 ml tap water in the tank, operated at 42 kHz in a continuous mode. After 30 minutes, the ultrasonic vibration was terminated and the produced colloidal nanoparticle solutions were held at room temperature for a few more hours before centrifuging isolation to ensure as complete reaction as possible. The eventual colloid colors are grey-yellow, ruby-red, black, grey-black and orange-yellow for Ag, Au, Pt, Ru and Cu2O, respectively. After three cycles of centrifuging and washing in ethanol, the isolated nanoparticles were redispersed in ethanol for characterization.

EXAMPLE 5

In a typical synthesis of copper nanoparticles, 50 ml aqueous solution of 0.4 M L-ascorbic acid (reagent grade, fine crystal, Fisher Scientific) and 0.8 M Polyvinylpyrrolidone (PVP) (in repeating unit, weight-average molecular weight of 58,000, Acros Organics) was directly mixed with another 50 ml aqueous solution of 0.01 M copper (II) nitrate (anhydrous, 99%, Acros Organics) and 0.8 M PVP under stirring. Then the mixture was kept in constant 45° C. without any inert gas protection. After about 1 h, the initial precursor solution with light blue color changed to red colloidal slurry, indicating the formation of Cu nanoparticles. After 3 h there was no further color change and red Cu nanoparticles were collected via centrifuge (8000 rpm for 30 min) of the colloid. Transmission electron microscope (TEM) images were obtained using Philips CM12 with 100 kV accelerating voltage. A Jeol 2010F with accelerating voltage of 200 kV was used for HRTEM image. Samples for the TEM imaging were prepared by placing a drop of the colloidal solution on a copper grid (400 meshes, Ted Pella Inc.) coated with formvar. X-ray diffraction patterns of the copper nanoparticles were recorded by using a Rigaku D/Max-B X-ray diffractometer (nickel filtered Cu Kα radiation (λ=1.54056 Angstrom) under 35 kV and 30 mA) with the powder sample dried on a microscope slide in a slurry form. The UV/visible absorption spectra of the copper nanoparticle colloids were recorded with a Cary 3E UV-Visible spectrophotometer.

Metal nanoparticles are basic building block of nanotechnology. They have been widely exploited for applications in photography, catalysis, biological labeling, photonics, optoelectronics, information storage, and formulation of magnetic ferrofluids. Development of manufacturing and fabrication methods for nanoparticles with the desired repeatable quality, at a high productivity, yielding large quantities at low cost, is central for commercialization of nanostructured materials. As shown in the description and examples above, the present invention provides three general routes synthesizing monodisperse nanoparticles of most transition metals as well as their alloys and oxides. One route for metal nanoparticles production is using metal foil as heterogeneous reducing medium with the deplating and mass transporting aid of mechanical and hydrodynamic forces. Another route is using ultrasound as a de-plating tool during the reduction of metallic ions by active metal foils or powders. The last route is a novel one-step synthesis of pure copper nanoparticles in aqueous solution with ascorbic acid as reductant and antioxidant as well. The spherical particles prepared show very small dimension, quite narrow size distribution and good stability. The combination of nontoxic and environmentally friendly reaction chemicals and solvent medium provides strong potential for future development of green nanomaterials preparation.

The invention described in terms of embodiments and examples can be realized and applied with modification within the spirit and scope of the claims followed.

The invention claimed is:

1. A method for making nanoparticles, comprising:

dipping a metal element in a solution that contains metallic ions or ions with a metal, wherein the metal element has a lower electronegativity or redox potential than that of the metal in the ions; and rubbing the metal element to make nanoparticles.

2. The method of claim 1, wherein the metal element is connected to a cathode and an anode is applied to the solution.

3. The method of claim 1, wherein the step of rubbing the metal element includes rubbing a rubbing member against the metal element, wherein at least one of the rubbing member and metal element is moving.

4. The method of claim 3, wherein the rubbing member is hairy.

5. The method of claim 3, wherein the rubbing member is solid.

6. The method of claim 1, further comprising repeating the steps of claim 1 with a different metal element and/or a different ion containing another metal to make core-shell structured nanoparticles.

7. The method of claim 1, the solution contains two or more metallic components to make intermetallic nanoparticles.

8. The method of claim 1, further comprising adding a gas to the solution to make nanoparticles.

9. The method of claim 8, wherein the nanoparticles are oxide nanoparticles.

10. The method of claim 8, wherein the gas is oxygen.

11. The method of claim 1, further comprising adding a surfactant to the solution.

12. The method of claim 11, wherein the surfactant is PVP.

13. The method of claim 11, further comprising adding an antioxidant to the solution.

14. The method of claim 1, further comprising adding an antioxidant to the solution.

15. The method of claim 14, wherein the antioxidant is ascorbic acid.

16. A method for making nanoparticles, comprising:

dipping a metal element in a solution that contains metallic ions or ions with a metal, wherein the metal element has a lower electronegativity or redox potential than that of the metal in the ions;

applying sonic energy to at least one of the metal element and solution; and repeating the steps of dipping and applying with a different metal element and/or a different ionic solution to make core-shell structured nanoparticles.

17. A method for making nanoparticles, comprising:

dipping a metal element in a solution that contains metallic ions or ions with a metal, wherein the metal element has a lower electronegativity or redox potential than that of the metal in the ions;

applying sonic energy to at least one of the metal element and solution; and adding a gas to the solution to make nanoparticles.

18. The method of claim 17, wherein the nanoparticles are oxide nanoparticles.

19. The method of claim 17, wherein the gas is oxygen.

* * * * *